US005725983A

United States Patent [19]

Yu

[11] Patent Number: 5,725,983

[45] Date of Patent: Mar. 10, 1998

[54] ELECTROPHOTOGRAPHIC IMAGING MEMBER WITH ENHANCED WEAR RESISTANCE AND FREEDOM FROM REFLECTION INTERFERENCE

[75] Inventor: Robert C. U. Yu, Webster, N.Y.

[73] Assignee: Xerox Corporation, Stamford, Conn.

[21] Appl. No.: 740,679

[22] Filed: Nov. 1, 1996

[51] Int. Cl.[6] ..... G03G 5/14

[52] U.S. Cl. ..... 430/58; 430/60; 430/66

[58] Field of Search ..... 430/58, 59, 60, 430/66

[56] References Cited

U.S. PATENT DOCUMENTS

| | | | |
|---|---|---|---|
| 4,618,552 | 10/1986 | Tanaka et al. | 430/60 |
| 4,647,521 | 3/1987 | Oguchi et al. | 430/58 |
| 4,654,284 | 3/1987 | Yu et al. | 430/59 |
| 4,664,995 | 5/1987 | Horgan et al. | 430/59 |
| 4,869,982 | 9/1989 | Murphy | 430/48 |
| 5,096,792 | 3/1992 | Simpson et al. | 430/58 |
| 5,096,795 | 3/1992 | Yu | 430/59 |
| 5,215,839 | 6/1993 | Yu | 430/58 |
| 5,437,950 | 8/1995 | Yu et al. | 430/83 |

*Primary Examiner*—John Goodrow

[57] ABSTRACT

An electrophotographic imaging member including a supporting substrate having an electrically conductive layer, a hole blocking layer, an optional adhesive layer, a charge generating layer, a charge transport layer, an anticurl back coating, a ground strip layer and an optional overcoating layer, at least one of the charge transport layer, anticurl back coating, ground strip layer and the overcoating layer comprising a blend of inorganic and organic particles homogeneously distributed in a film forming matrix in a weight ratio of between about 3:7 and about 7:3, the inorganic particles and organic particles having a particle diameter less than about 4.5 micrometers. These electrophotographic imaging members may have a flexible belt form or rigid drum configuration. These imaging members may be utilized in an electrophotographic imaging process.

18 Claims, 4 Drawing Sheets

ELECTROPHOTOGRAPHIC IMAGING MEMBER WITH ENHANCED WEAR RESISTANCE AND FREEDOM FROM REFLECTION INTERFERENCE

BACKGROUND INFORMATION

The present invention relates to an imaging system comprising an improved electrophotographic imaging member, which provides mechanically robust outer exposed layers and exhibits reduced plywooding type defects in output prints, particularly when imaged with coherent light radiation.

Typical electrophotographic imaging members include photosensitive members (photoreceptors) that are commonly utilized in electrophotographic (xerographic) processes in either a flexible belt or a rigid drum configuration. The flexible belt may be seamless or seamed.

These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may still function as an anode when the charge transport layer is sandwiched between the supporting electrode and a photoconductive layer which is capable of photogenerating electrons and injecting the photogenerated electrons into the charge transport layer. The charge transport layer in this latter embodiment must be capable of supporting the injection of photogenerated electrons from the photoconductive layer and transporting the electrons through the charge transport layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blacking layer, an adhesive layer, a charge generating layer, a charge transport layer and a conductive ground strip layer adjacent to one edge of the imaging layers. This photoreceptor may also comprise additional layers such as an anticurl back coating and an optional overcoating layer.

Imaging members are generally exposed to repetitive electrophotographic cycling which subjects the exposed charge transport layer thereof to abrasion, chemical attack, heat and multiple exposures to light. This repetitive cycling leads to a gradual deterioration in the mechanical and electrical characteristics of the exposed charge transport layer. Attempts have been made to overcome these problems. However, the solution of one problem often leads to additional problems.

When a production web stock of several thousand feet of coated multilayered photoreceptor is rolled up, the charge transport layer and the anticurl layer are in intimate contact. The high surface contact friction of the charge transport layer against the anticurl layer causes dimples and creases to develop in the internal layers of the photoreceptor. These physically induced defects are seen to manifest themselves into print defects in xerographic copies.

When ultrasonically welded into a belt, seams in some multilayered photoresponsive imaging members can delaminate during fabrication when larger webs are slit into smaller belt size sheets due to poor coating layers— adhesion. Further, after the sheets are welded into belts, the belts tend to exhibit imaging member surface cracking during extended cycling over small diameter support rollers or when subjected to lateral forces caused by rubbing contact with stationary web edge guides during cycling. Seam delamination is further aggravated when the belt is employed in electrophotographic imaging systems utilizing blade cleaning devices. In addition, imaging member coating layer delamination is also often encountered during web slitting operations to fabricate belt photoreceptors from wide webs. Moreover, the exposed outer layers such as charge transport layer, anticurl back coating, and conductive ground strip layer of electrophotographic imaging belts are subjected to constant mechanical actions against machine subsystems during imaging belts function. These subsystem mechanical interactions have been found to cause significant coating layer wear which shortens the service life of the imaging members.

There are numerous applications in the electrophotographic art wherein a coherent beam of radiation, typically from a helium-neon or diode laser, is modulated by an input image data signal. The modulated beam is directed (scanned) across the surface of a photosensitive medium. The medium can be, for example, a photoreceptor drum or belt in a xerographic printer, a photosensor CCD array, or a photosensitive film. Certain classes of photosensitive medium which can be characterized as "layered photoreceptors" have at least a partially transparent photosensitive layer overlying a conductive ground plane. A problem inherent in using these layered photoreceptors, depending upon the physical characteristics, is an interference effectively created by two dominant reflections of the incident coherent light on the surface of the photoreceptor, e.g., a first reflection from the top surface and a second reflection from the bottom surface of the relatively opaque conductive ground plane. Spatial exposure variations present in the image formed on the photoreceptor become manifest in the output copy derived from the exposed photoreceptor. The output copy exhibits a pattern of light and dark interference fringes which resemble the wood grains on a sheet of plywood, hence the expression "plywood effect" is generically applied to this problem. This phenomenon will be described later in greater detail in FIG. 4.

Alteration of materials in the various imaging member belt layers such as the conductive layer, hole blocking layer, adhesive layer, charge generating layer, and/or charge transport layer with the intent to reduce the occurrence of layer delamination, minimize wear of the exposed layers, or eliminate the plywood fringes effect is not easily effected because new materials added have usually been found to adversely affect the overall electrical, mechanical and other properties of the belt such as residual voltage, background, dark decay, flexibility and the like. For example, incorporation of crystalline particles in the outermost exposed layers of the imaging member to improve their wear resistance has been seen to cause excessive ultrasonic horn wear during ultrasonic welding of seams of imaging belts.

INFORMATION DISCLOSURE STATEMENT

U.S. Pat. No. 5,096,795 to R. Yu, issued Mar. 17, 1992—An electrophotographic imaging device is disclosed in which material for exposed layers contain either organic or inorganic particles uniformly dispersed therein. The particles provide reduced coefficient of surface contact friction, increased wear resistance, durability against tensile cracking, and improved adhesion of the layers without adversely affecting the optical and electrical properties of the imaging member.

U.S. Pat. No. 4,654,284 to R. Yu et al., issued Mar. 31, 1987—An imaging member is disclosed comprising at least one flexible electrophotographic imaging layer, a flexible supporting substrate layer having an electrically conductive surface and an anticurl layer, the anticurl layer comprising a film forming binder, crystalline particles dispersed in the film forming binder and a reaction product of a bifunctional chemical coupling agent with both the film forming binder and the crystalline particles. This imaging member may be employed in an electrostatographic imaging process.

U.S. Pat. No. 4,664,995 to A. Horgan et al., issued May 12, 1987—An electrostatographic imaging member is disclosed comprising at least one imaging layer capable of retaining an electrostatic latent image, a supporting substrate layer having an electrically conductive surface, and an electrically conductive ground strip layer adjacent the electrostatographic imaging layer and in electrical contact with the electrically conductive layer, the electrically conductive ground strip layer comprising a film forming binder, conductive particles and crystalline particles dispersed in the film forming binder, and a reaction product of a bifunctional chemical coupling agent with both the film forming binder and the crystalline particles. This imaging member may be employed in an electrostatographic imaging process.

U.S. Pat. No. 4,647,521 to Y. Oguch et al., issued Mar. 3, 1987—A photosensitive member, or image holding member, for electrophotography is disclosed having a conductive substrate, a top layer for holding an electrostatic image and/or toner image wherein the top layer is formed by applying a coating fluid containing hydrophobic silicon and a binder resin.

U.S. Pat. No. 4,869,982 to W. Murphy, issued Sep. 26, 1989—An electrophotographic photoreceptor is disclosed containing a toner release material in one or more electrically operative layers such as a charge transport layer. From about 0.5 to about 20 percent of a toner release agent selected from stearates, silicon oxides and fluorocarbons is incorporated into an imaging layer such as a charge transport layer.

U.S. Pat. No. 4,618,552 to S. Tanaka et al., issued Oct. 21, 1986—A light receiving member is disclosed comprising an intermediate layer between a substrate of a metal of an alloy having a reflective surface on a photosensitive member, the reflective surface of the substrate forming a light diffusing reflective surface, and the surface of the intermediate layer forming a rough surface. A light receiving member comprising a subbing layer having a light diffusing reflective surface with an average surface roughness of half or more of the wavelength of the light source for image exposure is provided between an electroconductive surface and a photosensitive layer. A light absorber can be contained in the electroconductive layer.

U.S. Pat. No. 5,215,839 to R. Yu, issued Jun. 1, 1993—A layered electrophotographic imaging member is disclosed. The member is modified to reduce the effect of interference caused by the reflections from coherent light incident on a ground plane. Modification involves an interface layer between a blocking layer and a charge generation layer, the interface layer comprising a polymer having incorporated therein filler particles of a synthetic silica or mineral particles. The filler particles scatter the light to prevent reflections from the ground planes back to the light incident the surface.

U.S. Pat. No. 5,096,792 to Y. Simpson et al, issued Mar. 17, 1992—A layered photosensitive imaging member is disclosed which is modified to reduce the effects of interference within the member caused by reflections from coherent light incident on a base ground plane. The modification involves a ground plane surface with a rough surface morphology by various selective deposition methods. Light reflected from the ground plane formed with the rough surface morphology is diffused through the bulk of the photosensitive layer breaking up the interference fringe patterns which are later manifested as a plywood pattern on output prints made from the exposed sensitive medium.

While the above mentioned electrophotographic imaging members may be suitable for their intended purposes, there continues to be a need for improved imaging members, particularly for material modified multilayered electrophotographic imaging members in both flexible belt and rigid drum configurations.

SUMMARY OF THE INVENTION

It is therefore an object of the present invention to provide improved layered electrophotographic imaging members which overcome the above noted disadvantages.

It is then an object of the present invention to provide an improved layered electrophotographic imaging member in either flexible belt or rigid drum configuration with a modified charge transport layer that exhibits superb wear resistance.

It is also an object of the present invention to provide an improved layered electrophotographic imaging member in either flexible belt form or rigid drum configuration with a modified charge transport layer that possesses both charge transporting function and anti reflection characteristics.

It is yet another object of the present invention to provide improved layered electrophotographic imaging members, in either flexible belt form or rigid drum configuration, having a charge transport layer in contact with a charge generating layer for use with liquid or dry developers.

It is still an object of the present invention to provide improved layered electrophotographic member flexible belts with modified anticurl back coating and ground strip layer that have enhanced wear resistant properties.

It is a further object of the present invention to provide improved layered flexible electrophotographic imaging belts having a modified charge transport layer that resists fatigue bending induced cracking.

It is also another object of the present invention to provide improved layered electrophotographic imaging members having a supporting substrate, a charge blocking layer, an optional adhesive layer, a charge generating layer, and a charge transport layer with better adhesion strength to resist layer delamination.

It is still another object of the present invention to provide improved negatively charging electrophotographic imaging members having a modified charge transport layer that exhibits reduced coefficient of friction against a clean It is another It is another object of the present invention to provide an improved layered flexible electrophotographic imaging members web having reduced surface contact friction between the charge transport layer and the anticurl back coating in rolled up webstock.

It is still a further object of the present invention to provide an improved layered flexible electrophotographic imaging members web having a blend of dispersed particles in the outermost exposed layers which do not cause ultrasonic horn wear during ultrasonic welding of seams of the imaging member belts.

It is yet another object of the present invention to provide improved layered electrophotographic imaging members in either flexible belt form or rigid drum configuration that exhibit high quality imaging and printing copy output.

These and other objects of the present invention are accomplished by providing an electrophotographic imaging member comprising a supporting substrate having an electrically conductive layer, a hole blocking layer, an optional adhesive layer, a charge generating layer, a charge transport layer, an anticurl back coating, a ground strip layer and an optional .overcoating layer, at least one of the charge transport layer, anticurl back coating, ground strip layer and overcoating layer comprising a blend of inorganic and organic particles homogeneously distributed in a weight ratio of between about 3:7 and about 7:3 in a film forming matrix, the inorganic particles and organic particles having a particle diameter less than about 4.5 micrometers. These electrophotographic imaging members may have a flexible belt form or rigid drum configuration. These imaging members may be utilized in an electrophotographic imaging process.

BRIEF DESCRIPTION OF THE DRAWINGS

A more complete understanding of the imaging device of the present invention purpose can be obtained by reference to the accompanying drawings wherein.

All these figures are merely schematic representations of the present invention and are not intended to indicate relative size and dimensions of electrophotographic imaging members or imaging apparatus or components thereof.

DETAILED DESCRIPTION OF THE DRAWINGS

For the sake of convenience, the invention will be described for electrophotographic imaging members in flexible belt form even though this invention includes electrophotographic imaging members having other suitable shapes such as a rigid drum configuration.

Figure 1:
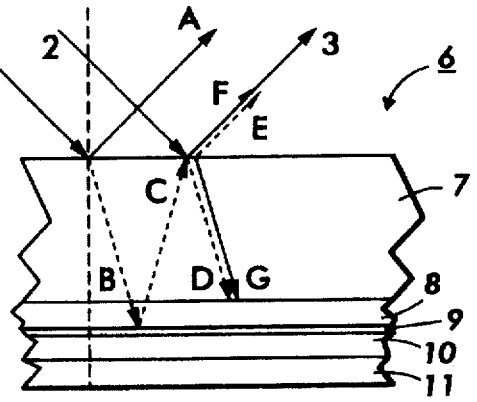
FIG. 1 PRIOR ART
FIG. 1 is a schematic representation showing coherent light incident upon a prior art layered photosensitive medium leading to reflections internal to the medium.

Referring to FIG. 1, a coherent beam is shown incident on a prior art layered electrophotographic imaging member 6 comprising a charge transport layer 7, charge generator layer 8, a conductive ground plane 9, a support substrate 10, and an anticurl back coating 11. The interference effects which occur can be explained by following two typical rays of the incident illumination. The two dominant reflections of a typical ray 1, are from the top surface of layer 7, ray A, and from the top surface of ground plane 9, ray C. The transmitted portion of ray C, ray E, combines with the reflected portion of ray 2, ray F, to form ray 3. Depending on the optical path difference as determined by the thickness and index of refraction of layer 7, the interference of rays F and E can be constructive or destructive when they combine to form ray 3. The transmitted portion of ray 2, ray G, combines with the reflected portion of ray C, ray D, and the interference of these two rays determines the light energy delivered to the generator layer 8. When the thickness is such that rays E and F undergo constructive interference, more light is reflected from the surface than average, and there will be destructive interference between rays D and G, delivering less light to generator layer 8 than the average illumination. When the transport layer 7 thickness is such that reflection is a minimum, the transmission into layer 8 will be a maximum. The thickness of practical transport layers varies by several wavelengths of light so that all possible interference conductions exist within a square inch of surface. This spatial variation in transmission of the top transparent layer 7 is equivalent to a spatial exposure variation of generator layer 8. This spatial exposure variation present in the image formed on the electrophotographic imaging member becomes manifest in the output copy derived from the exposed electrophotographic imaging member. The output copy exhibits a pattern of light and dark interference fringes which look like the wood grains on a sheet of plywood, hence the term "plywood effect" is generically applied to this problem. In the event that the ground plane 9 used for the imaging member fabrication is an optically transparent layer, the internal reflection that causes the interference effect for plywood formation will no longer be coming from the top surface of the ground plane but rather from the bottom surface of anticurl back coating 11 below, due to the refractive index mismatch between the anticurl back coating (e.g. having a refractive index of 1.56) and the air (e.g. having a refractive index of 1.0) as the internal ray B passes through the optically clear substrate support 10 and the optically clear anticurl back coating 11 before exiting to the air.

Figure 2:
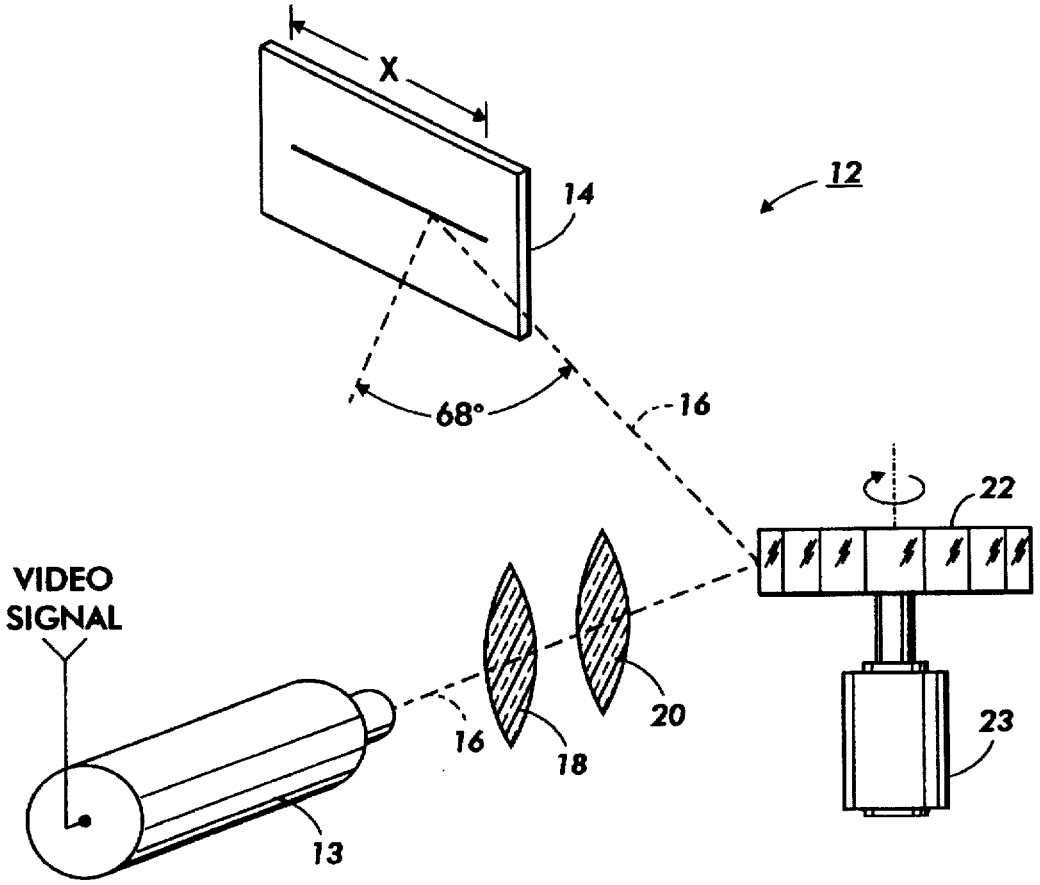
FIG. 2 is a schematic representation of an optical system incorporating a coherent light source to scan a light beam across an electrophotographic imaging member modified to reduce the interference effect according to the present invention.

FIG. 2 shows an imaging system 12 wherein a laser 13 produces a coherent output which is scanned across an electrophotographic imaging member 14. Laser 13 is, for this embodiment, a helium neon laser with a characteristic wavelength of 0.633 micrometer. However, it may instead be, for example, an AI Ga As Laser diode with a characteristic wavelength of 0.78 micrometer. In response to video signal information representing the information to be printed or copied, laser 13 is driven to provide a modulated light output beam 16. The laser output, whether gas or laser diode, comprises light which is polarized parallel to the plane of incidence. Flat field collector and objective lens 18 and 20, respectively, are positioned in the optical path between laser 13 and light beam reflecting scanning device 22. In a preferred embodiment, device 22 is a multifaceted mirror polygon driven by motor 23. Flat field collector lens 18 collimates the diverging light beam 16 and field objective lens 20 causes the collected beam to be focused onto electrophotographic imaging member 14, after reflection from polygon 22. Electrophotographic imaging member 14 can be a layered photoreceptor of the prior art having the structure shown in FIG. 4 or a modified layered photoreceptor 15, according to the present invention as shown in FIG. 5, the latter being capable of eliminating plywood interference fringes.

Figure 3:
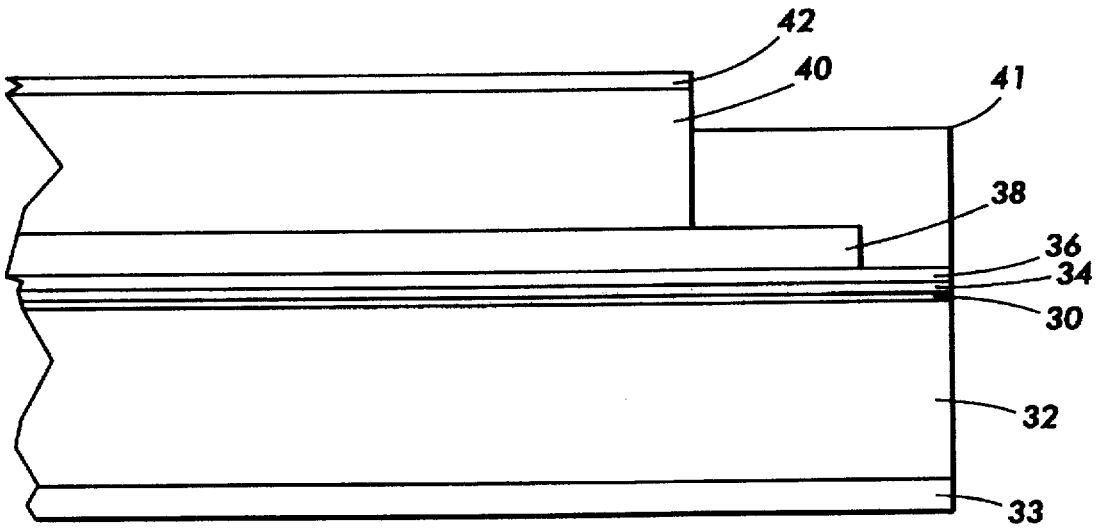
FIG. 3 is a complete schematic cross-sectional view of a typical prior art electrophotographic imaging member.

In the typical prior art electrophotographic imaging member shown in FIG. 3, the thickness of the substrate layer 32 depends on numerous factors, including mechanical strength and economical considerations, and thus, this layer for a flexible belt may, for example, have a thickness of at least about 50 micrometers, or of a maximum thickness less than about 150 micrometers, provided there are no adverse effects on the final electrophotographic imaging device. For drum type imaging member applications, the substrate is normally a rigid cylinder.

The conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive 30 layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, a hole blocking layer 34 may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may comprise nitrogen containing siloxanes or nitrogen containing titanium compounds as disclosed, for example, in U.S. Pat. Nos. 4,291,110, 4,338,387, 4,286,033 and 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and preferably has a thickness of less than about 0.2 micrometer.

An optional adhesive layer 36 may be applied to the hole blocking layer. Any suitable adhesive layer may be utilized. One well known adhesive layer comprises a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000 and a $T_g$ of about 32° C. If desired, the adhesive layer may comprise a copolyester resin. The adhesive layer comprising the polyester resin is applied to the blocking layer. Any adhesive layer employed should be continuous and, preferably, have a dry thickness between about 200 micrometers and about 900 micrometers and, more preferably, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Any suitable photogenerating layer 38 may be applied to the blocking layer 34 or adhesive layer 36, if one is employed, which can thereafter be overcoated with a contiguous hole transport layer 40. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light. The photogenerating materials selected should be sensitive to activating radiation having a wavelength between about about 600 and about 700 nm during the imagewise radiation exposure step in a electrophotographic imaging process to form an electrostatic latent image.

Any suitable inactive resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, and the like.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 40 may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 40 not only serves to transport holes or electrons, but also protects the photoconductive layer 38 from abrasion or chemical attack and therefor extends the operating life of the photoreceptor imaging member. The charge transport layer 40 should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of illumination.

The active charge transport layer 40 may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multilayer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N' -diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like. Molecular weights can vary, for example, from about 20,000 to about 1,500,000.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures thereof being incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Other layers such as conventional ground strip layer 41 comprising, for example, conductive particles dispersed in a film forming binder may be applied to one,edge of the photoreceptor in contact with the conductive layer 30, hole blocking layer, adhesive layer 36 or charge generating layer 38. The ground strip 41 may comprise a film forming polymer binder and electrically conductive particles. Typical ground strip materials include those enumerated in U.S. Pat. No. 4,664,995. The ground strip layer 41 may have a thickness from about 7 micrometers to about 42 micrometers, and preferably from about 14 micrometers to about 23 micrometers.

Optionally, an overcoat layer 42 may also be utilized to improve resistance to abrasion. In some flexible electrophotographic imaging members, an anticurl back coating 33 may be applied to the side opposite the side bearing the electrically active coating layers in order to provide flatness and/or abrasion resistance. These overcoating and anticurl back coating layers may comprise organic or inorganic film forming polymers that are electrically insulating or slightly semi-conductive. In embodiments using rigid drum imaging devices, an anticurl coating is usually not employed.

The electrophotographic imaging member of the present invention may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface.

Figure 4:
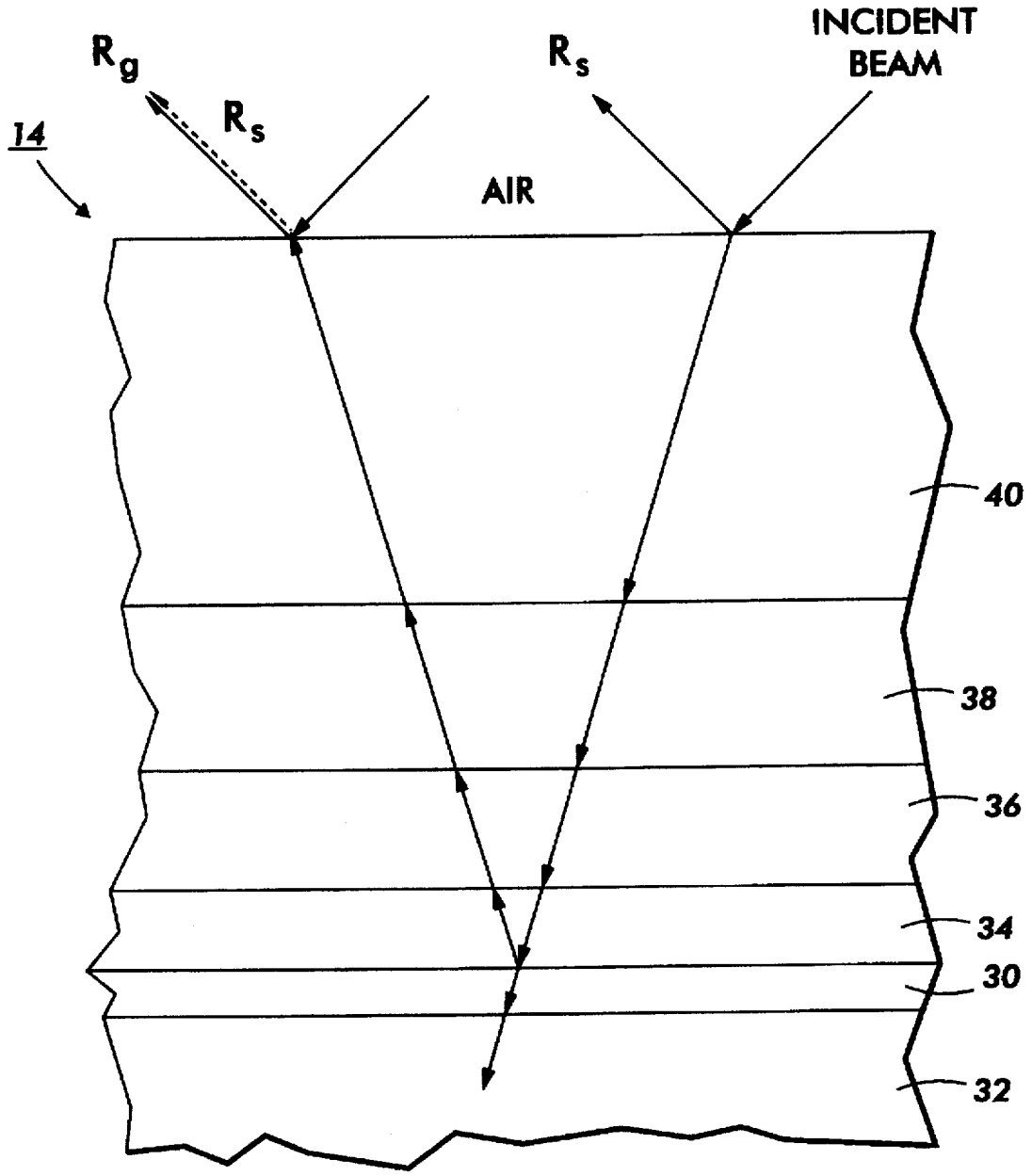
FIG. 4 is a partial schematic cross-sectional view of the electrophotographic imaging member of FIG. 3 with conventional coating layers to illustrate a plywood effect.
Figure 5:
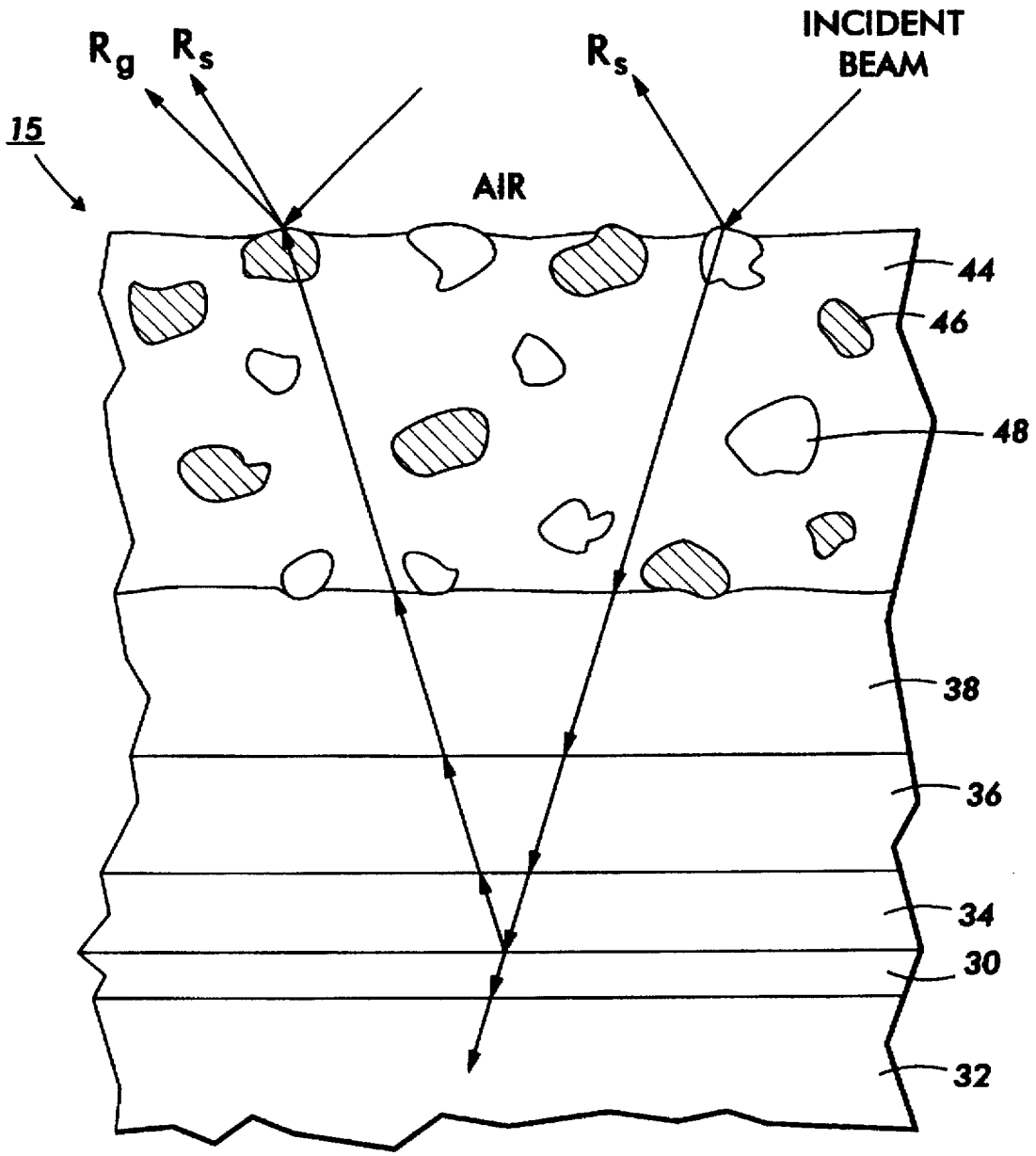
FIG. 5 is a partial schematic cross-sectional view of an electrophotographic imaging member similar to that shown in FIG. 4 except that the charge transport layer is modified, according to the present invention, by incorporation of a blend dispersed particles which create a rough textured surface which distorts both the reflection beam $R_s$ and the back reflecting light component $R_g$ of a coherent incident light.

Referring to FIG. 4, light beam (e.g. 633 nm wavelength) interaction with a specific electrophotographic imaging member is schematically illustrated. The electrophotographic imaging member 14 is a flexible layered photoreceptor which includes, for purposes of illustration, a titanium conductive ground plane 30 formed on a polyethylene terephthalate dielectric supporting substrate 32. Conductive layer 30 has formed thereon an organopolysiloxane a blocking layer 34 which functions as a hole blocking layer. Formed on top of blocking layer 34 is a polyester adhesive interface layer 36 which, in turn, is coated with a charge generation layer 38. A charge transport layer 40 overlies charge generation layer 38.

As shown in FIG. 4, one incident beam of light is partially reflected as beam $R_s$. The remainder of the incident beam of light enters the charge transport layer 40 and is bent, due to the refractive index difference between air (having a value of 1.0) and layer 40 (having a value of 1.57). Since the refractive indexes of all the internal layers 34, 36, 38 and 40 are about the same, no significant internal refraction is normally encountered and the light, therefore, travels in a straight line through these layers. Although the residual light energy (after large photon absorption by layer 38) that eventually reaches the thin conductive layer 30 is partially transmitted through conductive layer 30, nevertheless, a greater fraction is reflected back to layer 40 and exits to the air as beam $R_g$. The emergence of the light energy $R_g$ from the photoreceptor 14 directly interferes with the reflected light $R_s$, resulting in the formation of an observed plywood pattern effect.

The present invention overcomes the shortcomings of the prior art by providing an imaging member 15 with an improved charge transport layer 44 shown in FIG. 5. Charge transport layer 44 is a modification of the charge transport layer 40 shown in FIG. 4. Modification is achieved by dispersing a particulate blend of inorganic and organic particles 46 and 48 in the matrix material of the charge transport layer to provide mechanical reinforcement and enhance wear properties. Since the presence of this particulate blend dispersion in the material matrix can create a micro roughness or texturing change to the surface morphology of the transport layer which effectively deflects both the Rs and Rg beams, the root cause of interference fringes effect leading to the plywooding copy defect printout is suppressed or eliminated. To more specifically illustrate the adaptation of the dispersed particulate blend concept, charge transport layer 40 of the prior art electrophotographic imaging member 14 of FIG. 4 is modified, in accordance with one embodiment of this invention, to form a 24 micrometers (240,000 Angstroms) thick charge transport layer comprising 47.5 weight percent small charge transporting molecules, 47.5 weight percent film forming polymer, and 5 weight percent of a dispersed blend of inorganic and organic particles containing 50 percent by weight microcrystalline silica and 50 percent by weight Polymist, based on the total weight of the particles. The resulting electrophotographic imaging member 15, having the charge transport layer micro rough surface morphology, pictorially represented in FIG. 5, provides effective surface light deflection effect to eliminate interference fringes development as well as improving the wear resistance of the charge transport layer. The expression "micro rough surface morphology", as employed herein, is defined as a surface having a particle protrusion of from about 0.05 to 0.1 micrometer over the surface of the layer.

In another embodiment of this invention, the anticurl back coating 33 of the prior art electrophotographic imaging member of FIG. 3 is modified by the addition of an inorganic and organic particle blend to form a homogeneous dispersion which achieves wear resistance enhancement and reduces surface contact friction between the anticurl back coating and the charge transport layer in photoreceptor webs that are rolled up for storage prior to cutting and welding into belts. It is important that the presence of the particles blend in either charge transport layer or anticurl back coating should produce no deleterious impact on the photoelectrical function of the resulting charge transport layer nor alter the optical transmission of the anticurl back coating in embodiments where light must be transmitted through theses layers.

In another embodiment of this present invention, the ground strip layer 41 of the prior art electrophotographic imaging member is modified by incorporation of a blend of inorganic and organic particles to form a dispersion which boosts the wear property of the ground strip layer without decreasing the electrical conductivity of the resulting ground strip layer.

Surprisingly, the inorganic and organic particles selected for blending are easily dispersed by conventional coating mixing techniques and result in no particle agglomerations in the final dried charge transport layer, anticurl back coating, optional overcoating and/or ground strip layer embodiments of this invention. Since the inorganic particles of this invention have wear resisting characteristics while the organic particles, on the other hand, provide lubricity to ease the sliding mechanical interaction at an exposed coating layer surface, the combination of both of these types of particles to form a particle blend dispersed in a film forming matrix in an outermost coating layer of an electrophotographic imaging member produces a synergistic outcome that yields better wear properties than that achieved with either of the blend components used without the other. For charge transport layer and anticurl back coating applications, the dispersed blend of particles must have a refractive index closely matched with that of the film forming binder polymer of either the charge transport layer or the anticurl back coating so that particle dispersions in the polymer matrix of either layer do not affect the optical transmittance of the layer. Although refractive index matching between the particles blend and the matrix polymer binder is not a requirement for ground strip layer applications, nevertheless, it is necessary that their presence, at any loading level, shall not reduce the electrical conductivity of the final ground strip layer. It is important to point out that the presence of the particle blend dispersion of the present invention in the exposed coating layers for wear property enhancement and plywood fringes suppression produces no adverse impact on the overall photoelectrical performance of the resulting photoconductive imaging member. Furthermore, the dispersed particle blend of this invention in the imaging member coating layers, even at high loading levels, has not been seen to cause ultrasonic horn wear when the resulting photoconductive imaging member is ultrasonically welded into a seamed belt.

To satisfy the optical clarity requirement for charge transport layer and anticurl back coating applications, an inorganic filler of particular interest is microcrystalline silica, a naturally occurring irregular shape quartz particle. Microcrystalline silica particles are commercially available, for example, from Malvern Minerals Company. Microcrystalline silica also exists in two other forms (christobalite and tridymite). Since the microcrystalline silica, with a Moh Hardness Number of 7, has excellent abrasion resistance, it can therefore provide-enhanced wear resistance of a coating layer when it is dispersed in the material matrix of the layer. Other particulates of silica derivatives, such as micron size ground glass and micron size synthetic glass spheres (e.g., available from Cataphote Division, Ferro Corporation) may also be employed as the inorganic particle component of the improved layers of the present invention. To promote physical and chemical interactions between the inorganic silica particles and the film forming polymer binder matrix in the dispersed inorganic and organic particles blend concept of this invention, the microcrystalline silica particles are preferably surface treated with a suitable silane coupling agent. Although not limited to these materials, two specific exemplary bifunctional silane coupling agents are especially preferred. These preferred coupling agents are chloropropyl triethoxy silane having the molecular formula $Cl(CH_2)_3$—Si—$(OC_2H_5)_3$ and azido silane having a molecular formula $(CH_3CH_2O)_3$—Si—R—$SO_2N_3$. These coupling agents are preferred because they have the least effect on the delicate hole transport mechanism of the charge transport layer after particle bend dispersion. These silanes are employed in hydrolyzed forms because the OH groups of the hydrolyzed silanes readily react with the silanol functional groups of the microcrystalline silica surfaces and condense to form siloxane bonds at elevated temperature. The condensation reaction between the OH and silanol groups positions the siloxane at the surfaces of the silica particles and orient the organofunctional group outwardly to interact with the film forming polymer binder of the charge transport layer. This siloxane polymer interaction produces a reinforcement effect on the imaging member layers.

The hydrolyzed silane solution utilized to treat the microcrystalline silica may be prepared by hydrolyzing the alkoxy groups of a silane in an excess amount of water to form a dilute aqueous solution having about 0.1 weight percent to about 5.0 weight percent silane. A solution pH between about 9 and 13 is preferred. The control of the pH of the hydrolyzed silane solution may be achieved by acetic acid or hydrogen iodide addition. The silane microcrystalline silica surface treatment may be effected by washing the silica particles in the dilute hydrolyzed silane solution for about 1 minute to about 30 minutes. The resulting silica particles are filtered with a filter paper and dried at 135° C. in an oven for about 30 minutes to complete the silane surface treatment process. Alternatively, hydrolysis of the silane and surface treatment may also be effected directly at the surfaces of the microcrystalline silane particles as described, for example, in Example 2 of U.S. Pat. No. 3,915,735.

Other micrometer size inorganic particles having high hardness and exceptional wear resisting properties include, for example, diamond (Moh Hardness 10), corundum (Moh Hardness 9) and topaz (Moh Hardness 8).

Any suitable organic particles having a low surface coefficient of friction may be utilized in the particle blend. Although not limited to these materials, typical organic particles include, for example, ALGOFLON, POLYMIST, and ACUMIST are preferred for application in charge transport layers and anticurl back coatings containing a dispersed blend of inorganic and organic particles. These organic particles, having a refractive index closely matched with that of the binder polymer matrix of the charge transport layer and the anticurl back coating as well as possessing an inherent lubricating property, are selected for forming a particle blend dispersions with the inorganic particles described above because dispersions of a blend of these particles in the charge transport layer and/or the anticurl back coating do not alter the optical transmission of these coating layers nor affect the delicate electrophotographic imaging functions of the resulting imaging member.

ALGOFLON, available from Ausimont U.S.A., Inc., comprises irregular shaped polytetrafluoroethylene (PTFE) particles. These particles enhance slipping characteristics of the layer in which they are dispersed. Thus, when dispersed in a charge transport layer, ALGOFLON lowers the surface contact friction of the charge transport layer and eases the sliding mechanical interaction of the surface with other objects to minimize wear of the surface.

POLYMIST, available from Ausimont U.S.A., Inc., comprises irregularly shaped PTFE particles which are similar to ALGOFLON, with the exception that the particles are gamma ray irradiated to increase their hardness and particle rigidity without altering the lubricating property. As a result of gamma ray irradiation, the POLYMIST particles further impart improved their wear resistance properties when incorporated into the matrix of the-charge transport layer and the anticurl back coating.

ACU MIST, available from Allied-Signal, Inc., comprises irregularly shaped micronized waxy polyethylene particles having the molecular formula $CH_3(CH_2)_mCH_3$, in which m is the number of repeating units for a molecular weight between about 2000 and about 3500. The oxidized form of ACUMIST is a polyethylene homopolymer having a molecular formula $CH_3(CH_2)_mCH_2COOH$.

The above inorganic and organic particles, as supplied by the manufacturers, have particle size distributions from about 0.1 micrometer to about 9 micrometers in diameter. For charge transport layer dispersions, these particles are classified to give a preferred particle diameter range between about 0.1 micrometer and about 4.5 micrometers, with an average particle diameter of about 2.5 micrometers. If an overcoating layer is to be applied onto the charge transport layer, these blended particles should be classified further to yield an optimum particle size range from about 0.1 micrometer to about 1.5 micrometers when used in thin overcoating dispersions.

Since electrical conductivity rather than optical clarity is necessary for ground strip layer applications, any suitable wear enhancing inorganic and organic-particles may be utilized because refractive index matching and mismatch with the refractive index of the matrix polymer binder is not relevant. Therefore, opaque, translucent or transparent inorganic-particles, in addition to the transparent inorganic particles described above, are also considered to be within the scope of the present invention for any layers where transparency or refractive index matching is unimportant. Typical opaque, translucent, or transparent inorganic particles suitable for ground strip layer application include, for example, aluminum oxide (corundum), antimony oxide (senarmontite, valentinite), arsenic oxide (arsenolite, claudetite), iron oxide (hematite, magnetite), lead oxide (litharge, minium), magnesium oxide (periclas)o manganese oxide (hausmannite, manganosite, pyrolusite), nickel oxide (bunsenite), tin oxide (cassiterite), titanium oxide (brookite), zinc oxide (zincite), zirconium oxide (baddeleyite), barium sulfate (barite), lead sulfate (anglesite), potassium sulfate (arcanite), sodium sulfate (thernadite), antimony sulfite (stibnite), arsenic sulfide (orpiment, realgar), cadmium sulfide (greenockite), calcium sulfide (oldhamite), iron sulfide (mrcasite, pyrite, pyrrhotite), lead sulfide (galena), zinc sulfide (sphalerite, wurtzite), barium carbonate (witherite), iron carbonate (siderite), lead carbonate (cerussite), magnesium carbonate (magnesite), manganese carbonate (rhodochrosite), sodium carbonate (thermonatrite), zinc carbonate (smithsonite), aluminum hydroxide (boehmite, diaspore, gibbsite), iron hydroxide (goethite, lepidocrocite), manganese hydroxide (pydrochroite), copper chloride (nantokite), lead chloride (cotunnite), silver chloride (cerargyrite), silver iodide (jodyrite, miersite), lead chromate (crocoite), beryllium silicate (phenakite), sodium aluminosilicate (natrolite, mesolite, scolecite, thomasonite), zirconium silicate (zircon), as well as acmite (aegirine), brimstone (sulfur), carborundum (moissanite), chromspinel (chromite), epsomsalt (epsomite), garnet (almandine, pyrope, spessartite), indocrase (vesuvianite), iron spinel (hercynite), lithiophyllite (triphylite), orthite (allanite), peridote (olivine), pistacite (epidote), titanite (sphene), zinc sulfate, and the like. if desired, these particles can be subjected to a surface treatment process, with either a silane, a titanate, a zirconate coupling agent, or wax encapsulation, to suppress any hydrophilic properties and promote hydrophobic or organophilic properties as well as enhancing the physical and chemical interactions between the dispersed particles and the polymer matrix molecules. Typical opaque, translucent or transparent organic lubricating particles include, for example, KYNAR, fatty amides, metal stearates, and the like, in addition to the transparent inorganic particles described above, including the materials disclosed in U.S. Pat. No. 4,869,982, are also considered within the scope of the present particle blend ground strip layer dispersion of this invention. Thus, opaque, translucent, and transparent inorganic or organic particles which adversely affect the optical and/or photoelectrical integrity of a charge transport layer or an anticurl back coating layer may still be suitable for the particle blend applications in a ground strip layer, provided their dispersion in the ground strip layer matrix does not cause undesirable reduction of electrical conductivity in the resulting layer.

The particles to be used for the dispersed particle blend layers of the present invention may be incorporated directly as dispersion into the coating solution compositions used to prepare any of the exposed layers of an imaging member such as the charge transport layer, optional overcoat layer, anticurl back coating, and/or ground strip layer. The dispersed particle blend utilized in the exposed layers described above reduce the coefficient of friction, increase wear properties, improve tensile cracking resistance of the layers and also eliminate the interference plywood like fringe problem in copy print outs without adversely affecting the many important photoelectrical functions of the resulting electrophotographic imaging member.

The coating mixtures containing the dispersed particle blends of this invention can be applied by any suitable electrophotographic imaging member fabricating technique. Typical coating techniques include, for example, solvent coating, extrusion coating, spray coating, dip coating, lamination, solution spin coating and the like. Further, the coating mixtures containing a dissolved film forming binder, a dissolved photoelectrical sensitive compound, and the dispersed particle blend can also be used for seamless organic electrophotographic imaging member belt coating processes. The coated layer, containing the particle blend dispersion, may be dried by any suitable conventional drying techniques such as oven drying, forced air drying, circulating air oven drying, radiant heat drying, and the like.

The particle blend dispersion of the present invention can be present in the applied charge transport layer, anticurl back coating, optional overcoating layer and/or ground strip layer, of the imaging member in a range of about 0.1 to about 10 weight percent, based on the total weight of the dissolved solids and the dispersed particles, including the dispersed graphite in the case of ground strip layer. Optimum results may be obtained when the coating mixture for the charge transport layer contains a dispersed blend of particles in a concentration of between about 0.5 weight percent and about 6 weight percent, based on the total weight of the dried coating layer. Optimum results may be obtained when the coating mixture for an optional overcoating layer contains a particle blend dispersion in a concentration of between about 0.5 and about 6 weight percent, based on the polymer binder and any other overcoating layer material in the overcoating layer. For anticurl back coating applications, a dispersed blend of particles in a concentration of between about 0.1 weight percent and about 30 weight percent, based on the total weight of the dried anticurl coating layer, is satisfactory. However, a particle blend dispersion preferably contains from about 0.5 weight percent to about 20 weight percent. Optimum results are achieved for a particle blend dispersion containing between about 1 weight percent and about 10 weight percent. To improve wear resistance properties of the ground strip layer, a particle blend loading of from about 1 weight percent to about 20 weight percent, based on the total weight of the dissolved solids and the dispersed particles, is satisfactory. A concentration of between about 3 weight percent and about 15 weight percent is preferred. Optimum results are obtained for the electrically conductive ground strip layer when the particle blend dispersion concentration is between about 5 weight percent and about 10 weight percent.

The key to achieving improved wear resisting results is to maintain an inorganic particle to organic particle weight ratio of the dispersion blend in a range between about 3:7 and about 7:3. Preferably, the particle dispersion blend weight ratio is from about 4:6 to about 6:4. Optimum synergistic effects are achieved when the inorganic/organic particle dispersion blend weight ratio is about 5:5 or equal parts.

The dispersed inorganic and organic particle blend of the present invention increases resistance to fatigue cracking in the charge transport layer or in the optional overcoat layer. Since the particle blend has a high surface area, the mechanism of the particle blend contribution to the increase in cracking resistance of the coating layer is postulated to be the facilitation of reattachment of the ruptured chain segments of the matrix polymer onto the dispersed particles surface, attachment of dangling polymer chains to these dispersed particles, and sliding of polymer chains over the dispersed particles, to prevent catastrophic material failure caused by matrix polymer degradation due to the repetitive mechanical fatigue under a normal imaging belt image cycling.

With the exposed layers of the present invention, a decrease in surface contact friction is seen compared with layers which do not have the dispersed particle blend. Wear resistance is enhanced, resistance to tensile stress cracking in the charge transport layer is increased, adhesion at the interface between the charge transport layer and charge generating layer is promoted, and the generic interference fringes problem is also eliminated. Since the refractive index of the specifically selected dispersed particle blend is closely matched with the refractive index of the polymer binder (different in refractive index between the dispersed particles and the matrix polymer be less than 0.4), the optical clarity of the charge transport layer or optional overcoat layer and the anticurl back coating is maintained. Very importantly, these advantageous effects are obtained without producing a negative electrical impact on the final electrophotographic imaging member. It is particularly important to note that although the wear resistance of all the exposed imaging member layers can be effectively increased by dispersing only inorganic or only organic particles as disclosed in the prior art, the dispersed blend of inorganic and organic particles of the present invention has surprisingly been found to achieve a far better wear resistance improvement than using either component of the dispersion blend alone.

The invention will further be illustrated in the following non-limiting examples, it being understood that these examples are intended to be illustrative only and that the invention is not intended to be limited to the materials, conditions, process parameters and the like recited herein.

CONTROL EXAMPLE I

An electrophotographic imaging member was prepared by providing a 0.02 micrometer thick titanium layer coated on a polyester substrate (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed go dry for 5 minutes at 135° C. in a forced air oven. The resulting blocking layer had an average dry thickness of 0.05 micrometer measured with an ellipsometer.

An adhesive interface layer was then prepared by applying with a ½ mil gap Bird applicator to the blocking layer a wet coating containing 5 percent by weight based on the total weight of the solution of polyester adhesive (Mor-Ester 49,000, available from Morton International, Inc.) in a 70.30 volume ratio mixture of tetrahydrofuran/cyclohexanone. The adhesive interface layer was allowed to dry for 5 minutes at 135° C. in the forced air oven. The resulting adhesive interface layer had a dry thickness of 0.065 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methyl phenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter applied to the adhesive interface layer by using a ½ rail gap Bird applicator to form a coating layer having a wet thickness of 0.5 rail (12.7 micrometers). However, a strip about 10 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in the forced air oven to form a dry photogenerating layer having a thickness of 2.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbensabricken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

The approximately 10 mm wide strip of the adhesive layer left uncoated by the photogenerator layer was coated with a ground strip layer during the co-coating process. This ground strip layer, after drying at 135° C. in the forced air oven for 5 minutes, had a dried thickness of about 14 micrometers. This ground strip is electrically grounded, by conventional means such as a carbon brush contact means during conventional xerographic imaging process.

An anticurl coating was prepared by combining 8.82 grams of polycarbonate resin (Makrolon 5705, available from Bayer AG), 0.72 gram of polyester resin (Vitel PE-200, available from Goodyear Tire and Rubber Company) and 90.1 grams of methylene chloride in a glass container to form a coating solution containing 8.9 percent solids. The container was covered tightly and placed on a roll mill for about 24 hours until the polycarbonate and polyester were dissolved in the methylene chloride to form the anticurl coating solution. The anticurl coating solution was then applied to the rear surface (side opposite the photogenerator layer and charge transport layer) of the imaging member with a 3 mil gap Bird applicator and dried at 135° C. for about 5 minutes in the forced air oven to produce a dried film thickness of about 13.5 micrometers. The resulting electrophotographic imaging member had a structure similar to that schematically shown in FIG. 3 and was used as a control imaging member.

EXAMPLE II

An electrophotographic imaging member was prepared by following the procedures and using the same materials as described in the Control Example I, except that a I weight percent of a blend of inorganic and organic particles, consisting of equal parts of azido silane surface treated microcrystalline silicon (available from Malvern Minerals Company) and Polymist (PTFE particles available from Ausimort U.S.A., Inc.), was dispersed in the material matrix of the charge transport layer.

The charge transport layer mixture of this invention was prepared by dissolving 75 grams of Makrolon and 75 grams of N,N'-diphenyl-N,N'-bis(3-methylphenyl)-1,1'-biphenyl-4,4'-diamine in 850 grams of methylenechloride. A 1.5 grams of the particles blend was added to the solution and dispersed, with the aid of a high shear blade disperser (Tekmar Dispax Disperser), in a water cooled, jacketed container to prevent the mixture from overheating and loss of solvent due to evaporation.

EXAMPLE III

An electrophotographic imaging member was prepared as described in Example II, except that the dispersed blend of inorganic and organic particles in the charge transport layer was 3 weight percent with respect to the total weight of the resulting dried charge transport layer.

EXAMPLE IV

An electrophotographic imaging member was prepared as described in Example II except that the dispersed blend of inorganic and organic particles in the charge transport layer was 5 weight percent with respect to the total weight of the resulting dried charge transport layer.

EXAMPLE V

The electrophotographic imaging members of Control Example I and Examples II through IV were evaluated for interfacial contact friction between the charge transport layer and the anticurl back coating to assess the surface frictional interaction between these two contacting layers in a 6,000 feet wound up roll of imaging member webstock. The effect of the dispersed blend of particles in the charge transport layer of the imaging member on reflection light interference fringes suppression was also evaluated.

The coefficient of friction test was carried out by fastening the imaging member of each Example, with their charge transport layer facing upwardly, to a platform surface. The anticurl back coating of an imaging member was secured outwardly to the flat surface of the bottom of a horizontally sliding plate weighing 200 grams. The sliding plate was then dragged, with the anticurl back coating downwardly, in a straight line over the platform so that the anticurl back coating moved against the horizontal charge transport layer surface to create frictional interaction. The sliding plate was moved by a cable which had one end attached to the plate and the other end threaded around a free rotation pulley and fastened to the jaw of the Instron Tensile Tester. The pulley was positioned so that the segment of the cable between the weight and the pulley was parallel to the surface of the flat horizontal test surface. The cable was pulled vertically upward from the pulley by the jaw of the Instron Tensile Tester and the load which was required to slide the sliding plate, with the anticurl back coating surface over the charge transport layer surface, was monitored using a chart recorder. The coefficient of friction between the charge transport layer and the anticurl back coating was then calculated by dividing the sliding force or load recorded over the chart recorder by 200 grams.

To evaluate the effectiveness of the dispersed blend of inorganic and organic particles in the charge transport layer of this invention for suppressing the formation of plywood fringes during image development, the electrophotographic imaging members of Example I through VI were carefully examined under a coherent light source emitted forn a low pressure sodium lamp. The result obtained for coefficient of surface contact friction of the charge transport layer (CTL) against the anticurl back coating (ACBC) and the light reflection interference fringes examination are tabulated in Table I below:

TABLE I

| EXAMPLE | Particle Blend in CTL (%) | Coeff. of Friction CTL/ACBC | Wood Grain Fringes |
|---|---|---|---|
| I (Control | 0 | 3.1 | Intense |
| II | 1 | 0.71 | Diminished |
| III | 3 | 0.58 | Suppressed |
| IV | 5 | 0.52 | None |

The data shown in the Table indicate that particle blend dispersion in the imaging member transport layer matrix, at a concentration of 1, 3 or 5 weight percent, not only provided charge transport layer/anticurl backing coating surface contact friction reduction, it also effected suppression of wood grain interference fringes. In sharp contrast to the wood grain patterns observed in the control imaging member of Example I, diminishment of the intensity of the wood grain fringes was noticeable when 1 weight percent of the particles blend dispersion was present in the charge transport layer matrix of the imaging member of Example II. Significant suppression of interference fringes was effected when the particles blend dispersion was increased to 3 weight percent and total elimination of the wood grain fringes was clearly evident as the loading level of the particles blend dispersion in the charge transport layer of Example IV reached 5 weight percent.

When tested for photoelectrical properties using a xerographic scanner, all the imaging members containing a particles blend dispersion in the charge transport layer of the present invention gave good charging/discharging, good field induced dark decay electrical characteristic, and 10,000 cycles of electrical stability equivalent to the results obtained for the control imaging member counterpart of Example I.

COMPARATIVE EXAMPLE VI

An electrophotographic imaging member was prepared by following the procedures and using the same materials as described in Control Example I, except that a 1 weight percent of azido silane treated microcrystalline silica (available from Malvern Minerals Company) was dispersed in the material matrix of the charge transport layer.

COMPARATIVE EXAMPLE VII

An electrophotographic imaging member was prepared according to the description given in Comparative Example VI, except that the microcrystalline silica dispersion in the charge transport layer was 3 weight percent.

COMPARATIVE EXAMPLE VIII

An electrophotographic imaging member was prepared according to the description given in Comparative Example VI, except that the microcrystalline silica dispersion in the charge transport layer was 5 weight percent

COMPARATIVE EXAMPLE IX

An electrophotographic imaging member was prepared by following the procedures and using the same materials as described in Control Example I, except that a 1 weight percent of Polymist (PTFE particles, available from Ausimort U.S.A., Inc.) particles dispersion was present in the material matrix of the charge transport layer.

COMPARATIVE EXAMPLE X

An electrophotographic imaging member was prepared according to the description given in Comparative Example IX, except that the Polymist dispersion in the charge transport layer was 3 weight percent.

COMPARATIVE EXAMPLE XI

An electrophotographic imaging member was prepared according to the description given in Comparative Example IX, except that the Polymist dispersion in the charge transport layer was 5 weight percent.

EXAMPLE XII

The electrophotographic imaging members of Control Examples I to II, III, IV and Comparative Examples VI through XI were assessed for tensile cracking, stain, 180° peel strength, wear resistance, and ultrasonic welding horn interaction during imaging seam welding operations. Tensile cracking strain was determined by cutting several 1.27 cm.×10.16 cm imaging member samples, inserting one sample into the jaws of an Instron Tensile Tester using a 5.08 cm gauge, and pulling the sample to 3 percent strain with a mm/min. crosshead speed. The test sample is then removed from the Instron Tensile Tester and examined for charge transport layer cracking under a reflection optical microscope at 100 times magnification. If charge transport layer cracking does not occur, a fresh sample is tested following the same procedures, but at an increased incremental strain 0.25 percent higher than the previous one. The tensile strain determination was repeated, each time with a fresh sample, until charge transport layer cracking became evident. The strain at which the cracking occurred was recorded as the charge transport layer tensile cracking strain. The 180° peel strength was assessed by cutting a minimum of three 0.5 inch 1.2 cm.)×6 inches (15.24 cm.) imaging member samples from each of Examples I to IV and Examples VI through XI. For each sample, the charge transport layer was partially stripped from the test sample with the aid of a razor blade and then hand peeled to about 3.5 inches from one end to expose the underlying charge generating layer inside the sample. This stripped sample was then secured to a 1 inch (2.54 cm.)×6 inches (15.24 cm.) and 0.05 inch (0.254 cm.) thick aluminum backing plate (having the anticurl layer facing the backing plate) with the aid of a two sided adhesive tape. The end of the resulting assembly opposite the end from which the charge transport layer not stripped was inserted into the upper jaw of an Instron Tensile Tester. The free end of the partially peeled charge transport layer was inserted into the lower jaw of the Instron Tensile Tester. The jaws were then activated at a one inch/min. crosshead speed, a two inches chart speed and a load range of 200 grams, to 180° peel the sample at least two inches. The load was calculated to give the peel strength of the sample. The peel strength was determined to be the load required fro stripping the charge transport layer divided by the width, which is 1.27 cm., of the test sample.

The electrophotographic imaging members of Examples I to IV and VI through XI were cut to the size of 1 inch (2.54 cm.) by 12 inches (30.48 cm.) and tested for resistance to wear. Testing was effected by means of a dynamic mechanical cycling device in which glass tubes were skidded across the surface of the charge transport layer on each imaging member. More specifically, one end of the test sample was clamped to a stationary post and the sample was loped upward over three equally spaced horizontal glass tubes and then downwardly over a stationary guide tube through a generally inverted "U" shaped path with the free end of the sample secured to a weight which provided one pound per inch width tension on the sample. The face of the imaging member bearing the charge transport layer was facing downward such that it was allowed to contact the glass tubes for sliding mechanical action. The glass tubes had a diameter of one inch. Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotates about the shaft, two glass tubes were maintained at all times in sliding contact with the surface of the charge transport layer. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the charge transport layer was in sliding mechanical contact with a single stationary support tube during the testing. The rotation of the spinning disk was adjusted to provide the equivalent of 11.3 inches (28.7 cm.) per second tangential speed. The extent of the charge transport layer wear was measured using a permascope at the end of a 330,000 wear cycles test.

The results obtained for tensile cracking strain, 180° peel strength, and wear resistance are listed in the following Table II:

TABLE II

| Example | Particle Content in CTL | Cracking Strain (%) | Peel Strength (gms/cm) | Thickness Wear Off (microns) |
|---|---|---|---|---|
| I (Control) | None | 3.25 | 98.8 | 12.0 |
| II | 1% Particle Blend | 3.50 | 104.6 | 9.5 |
| III | 3% Particle Blend | 4.00 | 10.57 | 6.0 |
| IV | 5% Particle Blend | 4.25 | 108.6 | 3.0 |
| VI | 1% Silica | 3.50 | 99.5 | 10.0 |
| VII | 3% Silica | 4.00 | 102.3 | 7.0 |
| VIII | 5% Silica | 4.25 | 105.1 | 4.0 |
| IX | 1% Polymist | 3.50 | 99.7 | 10.5 |
| X | 3% Polymist | 4.00 | 101.1 | 8.0 |
| XI | 5% Polymist | 4.25 | 104.8 | 5.5 |

The results in Table II above show that the resistance of a charge transport layer against tensile stress cracking is improved. Even with the presence of only 1 weight percent of either inorganic filler, or organic particles, or inorganic/organic particle blend dispersion of the present invention, the resistance to to tensile stress cracking has been clearly demonstrated. The observed tensile cracking resistance enhancement is expected to extend the dynamic fatigue cracking life of the charge transport layer by more than two times (depending on the level of particle loading) when cycled against small 19 mm diameter belt module rollers during imaging belt machine operation.

Although incorporation of particles of any kind in the charge transport layer improves the interfacial bond strength between the charge transport layer and the charge generating layer, as reflected by the 180° peel measurements in Table II above, the particles blend dispersion was, unexpectedly, found to yield better adhesion results.

It is important to point out that although the particles, either using microcrystalline silica or Polymist, did provide significant wear resistance improvement, it was however surprising to discover that the mixing of wear resisting, hard inorganic particles and lubricating organic particles to form a particles blend dispersion in the material matrix of the charge transport layer could yield a synergistic effect which imparted to the resulting charge transport layer outstanding wear resistance far beyond that was provided by dispersions of either component of the blend. In addition to the observed superb wear resistance, it is should be noted that the imaging member of this invention having a 5 weight percent particles blend dispersion yielded the added benefit of avoiding scratching or abrasion of the ultrasonic welding horn during seam welding, as compared to the results of welding an imaging member belt loaded with 5 weight percent microcrystalline silica.

CONTROL EXAMPLE XIII

An anticurl back coating was prepared by combining 26.46 grams of polycarbonate resin (Makrolon 5705, available from Bayer AG), 2.16 grams of polyester resin (Vitel PE-200, available from Goodyear Tire and Rubber Company) and 270.3 grams of methylene chloride in a glass container to form a coating solution containing 8.9 percent solids. The container was covered tightly and placed on a roll mill for about 24 hours until the polycarbonate and polyester were dissolved in the methylene chloride to form the anticurl coating solution. The anticurl coating solution was then applied over a 3 mil thick polyester substrate (Melinex 442 available from ICI Americas, Inc.) with a 3 mil gap Bird applicator and then dried at 135° C. for about 5 minutes in the forced air oven to produce a dried film thickness of about 13.5 micrometers. The resulting anticurl back coating served as a control.

EXAMPLE XIV

An anticurl back coating was prepared according to the process of Control Example XIII, except that a 0.867 gram of inorganic/organic particles blend, consisting of equal parts of azido silane surface treated microcrystalline silica (available from Malvern Minerals Company) and Polymist (PTFE particles, available from Ausimort U.S.A., Inc.), was added to the coating solution. The coating solution was mixed with the aid of a high shear blade Tekmar Dispax disperser, in a water cooled, jacketed container to prevent the mixing solution from overheating and lost of solvent due to evaporation. After applying the mixed solution over a 3 mil thick polyester substrate support, using a 3 mil gap Bird applicator and dried at 135° C. for about 5 minutes in the forced air oven, the 13.5 micrometer thick dry anticurl back coating contained 3 weight percent of the particle blend dispersion in the material matrix based on the total weight of the anticurl back coating.

EXAMPLE XV

An anticurl back coating was prepared according to the process of Example XIV, except that the particles blend dispersion in the resulting anticurl back coating was 5 weight percent.

COMPARATIVE EXAMPLE XVI

An anticurl back coating was prepared according to the process of Example XIV, except that the particles blend dispersion in the resulting anticurl back coating was replaced with 3 weight percent of microcrystalline silica.

COMPARATIVE EXAMPLE XVII

An anticurl back coating was prepared according to the process of Example XVI, except that the microcrystalline silica dispersion in the resulting anticurl back coating was 5 weight percent.

COMPARATIVE EXAMPLE XVIII

An anticurl back coating was prepared according to the process of Example XIV, except that the particles blend dispersion in the resulting anticuff back coating was replaced with 3 weight percent of Polymist.

COMPARATIVE EXAMPLE XIX

An anticurl back coating was prepared according to the process of Example XVIII, except that the Polymist dispersion in the resulting anticurl back coating was 5 weight percent.

EXAMPLE XX

The anticurl back coatings (ACBC) of Control Example XIII and Examples XIV to XIX were evaluated for adhesion strength and wear resistance. The adhesion strength determination was carried out by following the 180° peel strength measurement described in Example XII, whereas the wear resistance measurement was conducted against glass skid plates to 330,000 wear cycles according to the procedures detailed in Example XIII. The results collected are summarized in Table III below:

TABLE III

| Example | Particle Content in ACBC | Peel Strength (gms/cm) | Thickness Wear Off (microns) |
|---|---|---|---|
| XIII | None | 65 | 10 |
| XIV | 3% Particle Blend | 82 | 7.5 |
| XV | 5% Particle Blend | 90 | 3.0 |
| XVI | 3% Silica | 79 | 8.0 |
| XVII | 5% Silica | 85 | 4.0 |
| XVIII | 3% Polymist | 78 | 8.5 |
| XIX | 5% Polymist | 84 | 5.5 |

Although the adhesion bond strength improvement between the anticurl back coating and the polyester substrate support for the sample containing the particle blend dispersion of this invention was greater than when a single component of either microcrystalline silica or Polymist is utilized, this difference was small. However, the inorganic/organic particles blend dispersion in the anticurl back coating yielded synergistic effect, as also seen in the Examples of charge transport layer, to boost the wear resistance enhancement of the resulting anticurl back coating far beyond the results obtained for either single component dispersion.

Since the refractive index of either microcrystalline or Polymist particles was a near match to that of the polymer matrix of the anticurl back coating, particles dispersion of these materials did not significantly alter the optical transmission of any of the anticurl backing coatings of Examples XIV through XIX when measurements were carried out with a spectrophotometer scanning from 400 to 700 nm wavelengths and equipped with an integrating sphere.

CONTROL EXAMPLE XXI

A ground strip layer was applied over a substrate containing a 200 Angstrom thick titanium layer on a 3 mil thick Melinex 442 polyester substrate which was pre-coated with a 0.05 micrometer silane blocking layer and a 0.065 micrometer Mor-Ester 49,000 as described in Control Example I. The ground strip layer coating solution was prepared by combining 5.25 grams of polycarbonate resin (Makrolon 5705, available from Bayer AG), and 73.17 grams of methylene chloride in a plastic container. The container was covered tightly and placed on a roll mill for about 24 hours until the polycarbonate was dissolved in the methylene chloride. The resulting solution was mixed for 15–30 minutes with about 20.72 grams of a graphite dispersion (12.3 percent by weight solids) of 9.41 parts by weight graphite, 2.87 parts by weight ethyl cellulose and 87.7 parts by weight solvent (Acheson Graphite dispersion RW22790, available Acheson Colloids Company) with the aid of a high shear blade disperser (Tekmar Dispax Disperser) in a water cooled, jacketed container to prevent the dispersion from overheating and losing solvent. The resulting dispersion was then adjusted to give a viscosity of between 325–375 centipoises with addition of methylene chloride. This ground strip layer coating solution was then applied to the substrate, using a 3 mil gap Bird applicator to form an electrically conductive ground strip layer having a thickness of about 18 micrometers after drying in the forced air oven for 5 minutes. This ground strip layer is used to serve as a control.

EXAMPLE XXII

A ground strip layer was prepared according to the process of Control Example XXI, except that the resulting 18 micrometer thick dry ground strip layer matrix contained 2.5 weight percent of an inorganic/organic particle blend dispersion of equal parts of azido silane treated microcrystalline silica (available from Malvern Minerals Company) and Polymist (PTFE particles, available from Ausimort U.S.A., Inc.).

EXAMPLE XXIII

A ground strip layer was prepared according to the process of Example XXII, except that the particle blend dispersion in the ground strip matrix was 7.5 weight percent.

EXAMPLE XXIV

The ground strip layer of Control Example XXI and Examples XXII and XXIII of this invention were evaluated for wear resistance against a glass skid plate to 330,000 wear cycles, according to the procedures detailed in Example XIII, but under a stressful environmental condition of 105° F. and 85 percent relative humidity. The results obtained show that a 2.5 weight percent of particle blend dispersion could provide a wear resistant enhancement approximately 3 times better than that of the control ground strip layer. At a high loading level of 7.5 weight percent dispersion, the wear of the ground strip of this invention was only about 10 percent of that seen for the control ground strip counterpart. It is also important to note that particles blend dispersions of both loading levels in the ground strip layer material matrix did not affect the electrical conductivity of the resulting ground strip layers. The ground strip layers of Examples XXI to XXIII were each tested for ground strip adhesion. A cross hatched pattern was formed on the ground strip layer by cutting through the thickness of the ground strip layer with a razor blade. The cross hatched pattern consisted of perpendicular slices 5 mm apart to form tiny separate squares of the ground strip layer. Adhesive tapes were then pressed against the ground strip layer and thereafter peeled off from the ground strip layer. The tests were made with two different adhesive tapes. One tape was Scotch Brand Magic Tape #810, available from 3M Corporation having a width of 0.75 inch while the other tape was Fas Tape #445, available from Fasson Industrial Div., Avery International. After application of the tapes to the ground strip layer, one tape of each brand was peeled in a direction perpendicular to the surface of the ground strip layer and one tape of each brand was peeled in a direction parallel, or 180°, to the outer surface of the same tape still adhering to the surface of the ground strip layer. Peeling off of the tapes failed to remove any of the ground strip layer from the underlying layers thereby demonstrating the excellent adhesion of these ground strip layers to the underlying layers.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a supporting substrate having an electrically conductive layer, a hole blocking layer, an optional adhesive layer, a charge generating layer, a charge transport layer, an anticurl back coating, a ground strip layer and an optional overcoating layer, at least one of said charge transport layer, anticurl back coating, ground strip layer and overcoating layer comprising a blend of inorganic and organic particles in a weight ratio of between about 3:7 and about 7:3 homogeneously distributed in a film forming matrix, said inorganic and organic particles having a particle diameter less than about 4.5 micrometers.

2. The electrophotographic imaging member of claim 1, wherein said dispersed organic and inorganic particles have a particle diameter substantially less than the thickness of the layer or coating containing said particles.

3. The electrophotographic imaging member of claim 1, wherein said organic and inorganic particles have a particle diameter of between about 0.1 micrometer to about 1.5 micrometers and are dispersed in said overcoating layer.

4. The electrophotographic imaging member of claim 1, wherein said overcoating layer comprises between about 0.1 percent by weight to about 10 percent by weight of said organic and inorganic particles, based on the total weight of said overcoating layer.

5. The electrophotographic imaging member of claim 1, wherein said transport layer comprises between about 0.5 percent by weight to about 6 percent by weight of said organic and inorganic particles, based on the total weight of said transport layer.

6. The electrophotographic imaging member of claim 1, wherein said anticurl back coating comprises between about 0.1 percent by weight to about 30 percent by weight of said organic and inorganic particles, based on the total weight of said anticurl back coating.

7. The electrophotographic imaging member of claim 1, wherein said ground strip layer comprises between about 1 percent by weight to about 20 percent by weight of said organic and inorganic particles, based on the total weight of said ground strip layer.

8. The electrophotographic imaging member of claim 1, wherein said inorganic particles consist of microcrystalline silica having a Moh hardness of at least about 7.

9. An electrophotographic imaging member comprising a charge transport layer comprising a thermoplastic film forming binder matrix, charge transport molecules and a homogeneous dispersion of a blend of
organic and
inorganic particles in a weight ratio of between about 3:7 and about 7:3 homogeneously distributed in said film forming binder matrix, said inorganic and organic particles having a particle diameter less than about 4.5 micrometers.

10. The electrophotographic imaging member of claim 9, wherein said dispersed particles have a particle diameter substantially less than the thickness of said charge transport layer.

11. The electrophotographic imaging member of claim 9, wherein said charge transport layer comprises between about 0.1 percent by weight to about 10 percent by weight of said blend of particles, based on the total weight of said charge transport layer.

12. The electrophotographic imaging member of claim 9, wherein said blend of organic and inorganic particles have an average particle diameter of about 2.5 micrometers.

13. The electrophotographic imaging member of claim 9, wherein said inorganic particles are naturally occurring microcrystalline silica particles.

14. The electrophotographic imaging member of claim 13, wherein said microcrystalline silica particles have a Moh hardness of at least about 7.

15. The electrophotographic imaging member of claim 13, wherein surfaces of said microcrystalline silica particles are treated with a bifunctional silane coupling agent.

16. The electrophotographic imaging member of claim 9, wherein said charge transport layer comprises about 0.1 percent by weight to about 10 percent by weight of said blend of organic and inorganic particles, based on the total weight of said charge transport layer.

17. The electrophotographic imaging member of claim 9, wherein said charge transport molecules comprise a charge transporting arylamine compound.

18. An electrophotographic imaging member comprising a supporting substrate having an electrically conductive layer, a hole blocking layer, an optional adhesive layer, a charge generating layer, a charge transport layer, an anticurl back coating, a ground strip layer and an optional overcoating layer, at least one of said charge transport layer, anticurl back coating, ground strip layer and overcoating layer comprising a blend of inorganic naturally occurring microcrystalline silica particles having a Moh hardness of at least about 7 and organic particles in a weight ratio of between about 3:7 and about 7:3 homogeneously distributed in a film forming matrix, said inorganic and organic particles having a particle diameter less than about 4.5 micrometers.

* * * * *